US012196214B1

(12) United States Patent
Liu et al.

(10) Patent No.: US 12,196,214 B1
(45) Date of Patent: Jan. 14, 2025

(54) DOUBLE-LAYER BLADE CEILING FAN CAPABLE OF ADJUSTING ARRANGEMENT OF BLADES

(71) Applicant: AIR COOL INDUSTRIAL CO., LTD., Taichung (TW)

(72) Inventors: Tim Liu, Taichung (TW); Joseph Warren Harris, Canton, GA (US)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 18/632,282

(22) Filed: Apr. 11, 2024

(51) Int. Cl.
*F04D 25/08* (2006.01)
*F04D 25/16* (2006.01)
*F04D 29/36* (2006.01)

(52) U.S. Cl.
CPC ..... *F04D 25/088* (2013.01); *F04D 25/163* (2013.01); *F04D 29/364* (2013.01)

(58) Field of Classification Search
CPC ..... F04D 25/088; F04D 25/163; F04D 29/364
See application file for complete search history.

(56) References Cited

U.S. PATENT DOCUMENTS 4,342,073 A * 7/1982 Ranten ..... F04D 25/088 362/147
4,936,751 A * 6/1990 Marshall ..... F04D 29/34 416/246
5,330,323 A * 7/1994 Swanson ..... F04D 29/34 416/219 A
6,059,531 A * 5/2000 Tai ..... F04D 29/34 416/207
D598,090 S * 8/2009 Pittman ..... F04D 19/024 D23/377
8,449,252 B2 * 5/2013 Van Otten Tolman ..... F04D 25/088 416/201 A
9,416,982 B2 * 8/2016 Kim ..... F24F 1/38
9,995,305 B2 * 6/2018 Golm, Jr. ..... F04D 29/665
10,100,846 B2 * 10/2018 Peery ..... F04D 29/666
10,202,981 B2 * 2/2019 Lin ..... F04D 17/025
11,686,321 B2 * 6/2023 Harris ..... F04D 19/007 416/210 R
D1,040,328 S * 8/2024 Deng ..... D23/377
2004/0253104 A1 * 12/2004 Liu ..... F04D 29/364 416/48
2005/0249598 A1 * 11/2005 Young ..... F04D 19/024 416/198 R (Continued)

*Primary Examiner* — Brian Christopher Delrue
(74) *Attorney, Agent, or Firm* — Ying-Ting Chen

(57) ABSTRACT

A double-layer blade ceiling fan capable of adjusting the arrangement of blades includes a motor and at least two blades. The motor has a stationary part and two rotating parts. The rotating parts are spaced apart from the stationary part. The rotating parts each have a plurality of mounting portions that are arranged around a central axis of the motor. The stationary part has an upper connecting portion and a lower connecting portion. The mounting portion is configured for connection of one of the blades. At least one of the blades is fixed to each of the rotating parts. The blades mounted to the rotating parts are selectively arranged in a same or different pattern for regulating air flow. When the blades and the rotating parts are rotated, the upper connecting portion and the lower connecting portion are not affected.

10 Claims, 7 Drawing Sheets

(56) References Cited

U.S. PATENT DOCUMENTS

| | | | | |
|---|---|---|---|---|
| 2011/0020135 | A1* | 1/2011 | Itou | F04D 29/563<br>416/244 R |
| 2011/0171021 | A1* | 7/2011 | VanOtten Tolman | F04D 19/024<br>416/128 |
| 2011/0243745 | A1* | 10/2011 | Ko | F04D 25/088<br>416/210 R |
| 2012/0034085 | A1* | 2/2012 | Lagman | F04D 29/34<br>29/889.3 |
| 2015/0198175 | A1* | 7/2015 | Lin | F04D 29/34<br>416/212 R |
| 2016/0131152 | A1* | 5/2016 | Wang | F04D 19/002<br>416/214 R |
| 2023/0143101 | A1* | 5/2023 | Harris | F04D 29/601<br>416/210 R |

* cited by examiner

DOUBLE-LAYER BLADE CEILING FAN CAPABLE OF ADJUSTING ARRANGEMENT OF BLADES

FIELD OF THE INVENTION

The present invention relates to a ceiling fan, and more particularly, to a double-layer blade ceiling fan capable of adjusting the arrangement of blades.

BACKGROUND OF THE INVENTION

In general, conventional ceiling fans are secured to the ceiling. The ceiling fan has a rotating unit and a plurality of blades. The rotating unit has a plurality of locking hole portions. The blades each have a mounting hole portion. The locking hole portions and the mounting hole portion each have two screw holes. A plurality of screws are screwed to the locking hole portions of the rotating unit and the mounting holes of the blades. The number of the locking hole portions of the rotating unit is equal to the number of the mounting holes of the blades, so the ceiling fan can only provide one air flow mode.

When the ceiling fan is running, it is prone to poor air convection. Accordingly, the inventor of the present invention has devoted himself based on his many years of practical experiences to solve these problems.

SUMMARY OF THE INVENTION

The primary object of the present invention is to provide a double-layer blade ceiling fan capable of adjusting the arrangement of blades, which has the effects of adjusting the arrangement of blades, regulating air flow, improving air convection and enhancing the strength of air convection.

In order to achieve the above object, the double-layer blade ceiling fan provided by the present invention comprises a motor, at least two blades, and a mounting structure.

The motor includes a stationary part and two rotating parts. The motor has a central axis. The stationary part has an upper connecting portion and a lower connecting portion. The rotating parts are spaced apart from the upper connecting portion and the lower connecting portion of the stationary part. The rotating parts are defined as an upper rotating part and a lower rotating part, respectively. The upper rotating part and the lower rotating part are disposed on upper and lower sides of the motor, respectively. The rotating parts rotates about the central axis. The rotating parts each have a plurality of mounting portions that are arranged around the central axis. The upper connecting portion and the lower connecting portion are located on upper and lower ends of the motor. The upper connecting portion and the lower connecting portion are close to the central axis. The rotating parts are far away from the central axis.

The blades each have a coupling portion. At least one of the blades is fixed to each of the rotating parts. The coupling portion of each blade is secured to one of the mounting portions of a corresponding one of the rotating parts through a fixing unit. The number of the coupling portions of the blades secured to the upper rotating part is less than the number of the mounting portions of the upper rotating part. The number of the coupling portions of the blades secured to the lower rotating part is less than the number of the mounting portions of the lower rotating part. Each blade is selectively secured to the mounting portion of the corresponding rotating part.

The mounting structure is located above the motor. One end of the mounting structure is fixedly connected to the upper connecting portion. Another end of the mounting structure is fixedly connected to a ceiling.

When in use, the positions of the blades to be mounted are selective. The blades mounted to the rotating parts are selectively arranged in a same or different pattern. When the blades and the rotating parts are rotated, the upper connecting portion and the lower connecting portion are not affected.

DETAILED DESCRIPTION OF THE PREFERRED EMBODIMENTS

Figure 1:
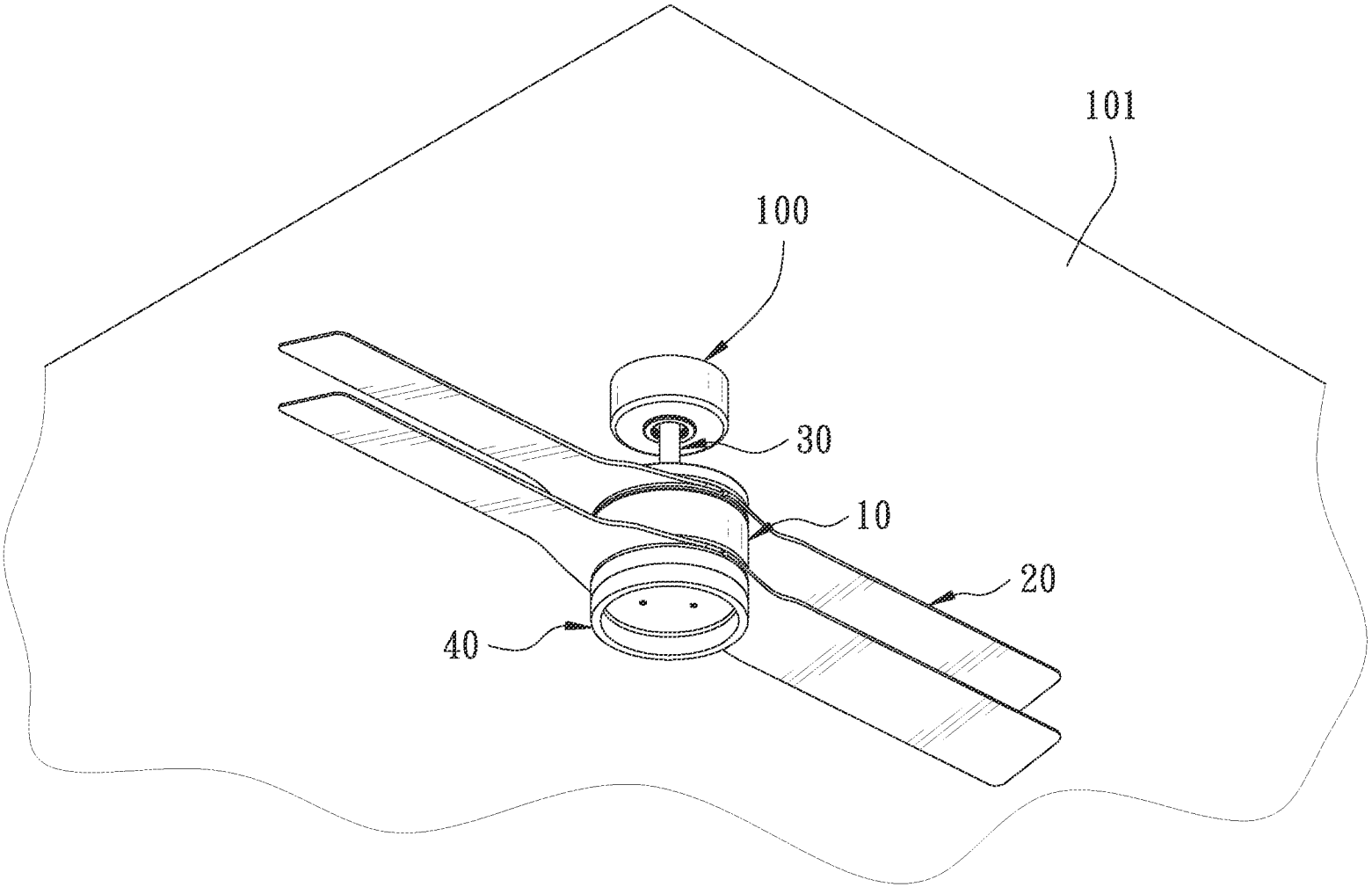
FIG. 1 is a perspective view of a first embodiment of the present invention, wherein the blades mounted to the rotating parts are arranged in the same pattern.
Figure 2:
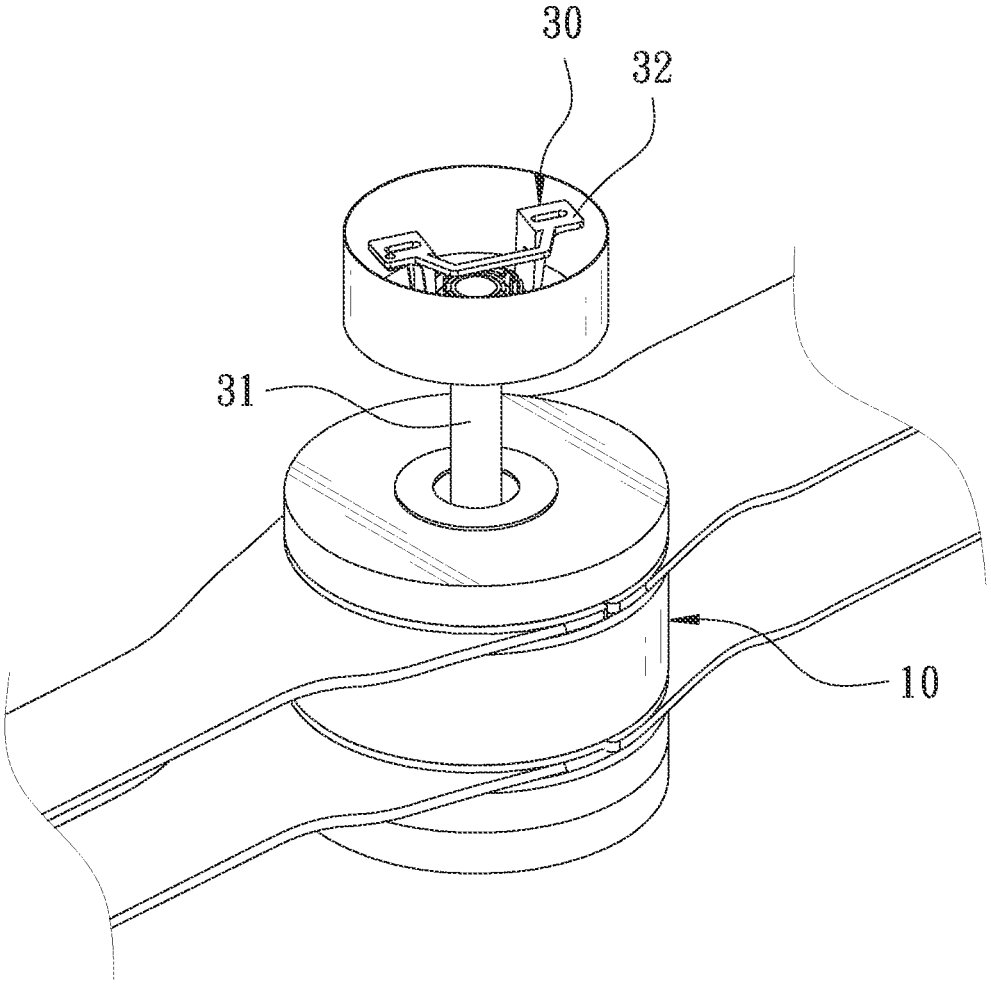
FIG. 2 is a schematic view of the first embodiment of the present invention when in use.
Figure 3:
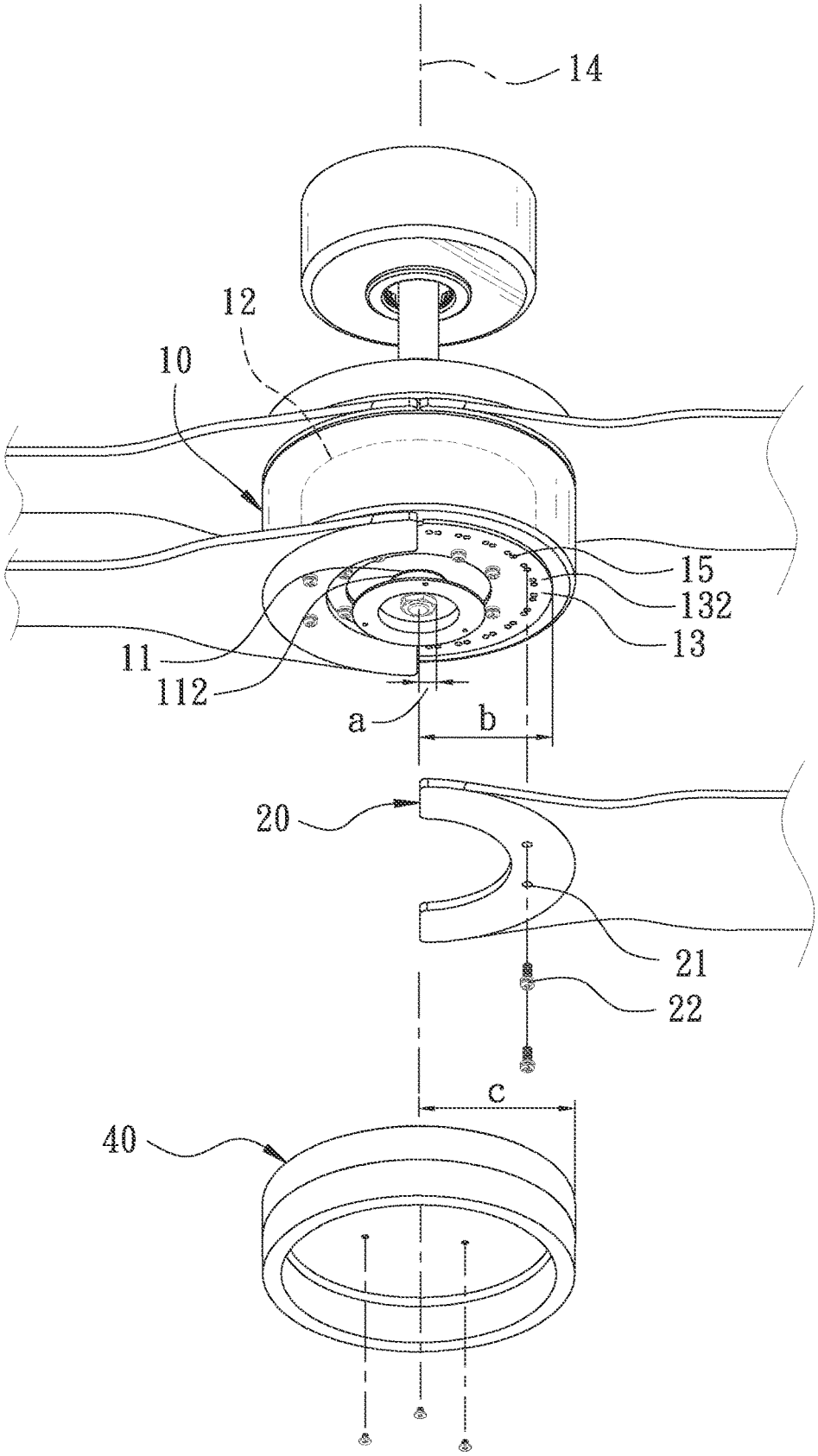
FIG. 3 is a partial exploded view of the first embodiment of the present invention, illustrating the lower rotating part.
Figure 4:
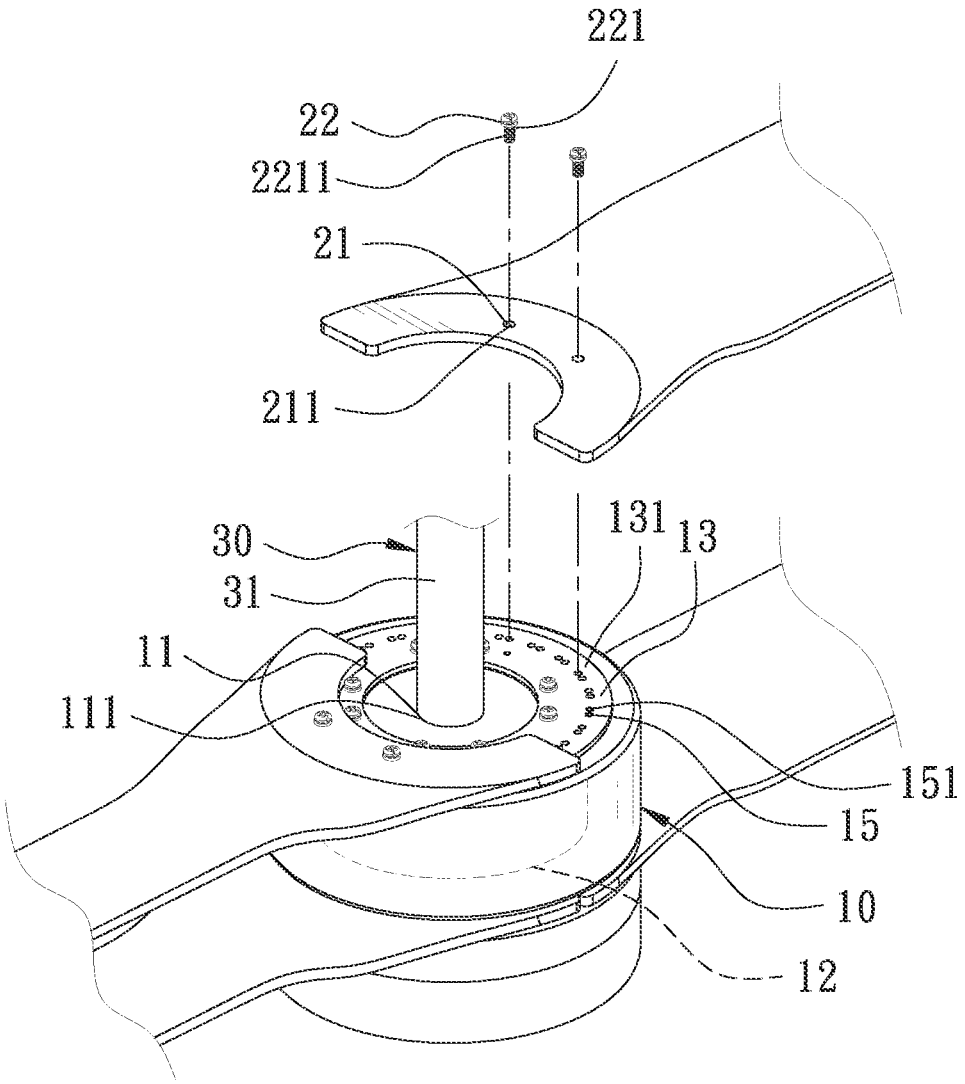
FIG. 4 is a partial exploded view of the first embodiment of the present invention, illustrating the upper rotating part.

Embodiments of the present invention will now be described, by way of example only, with reference to the accompanying drawings.

FIG. 1 through FIG. 4 illustrate a first embodiment of the present invention. The present invention discloses a double-layer blade ceiling fan 100 capable of adjusting the arrangement of blades, comprising a motor 10, at least two blades 20, a mounting structure 30, and a lamp 40.

The motor 10 includes a stationary part 11, a rotor 12, and two rotating parts 13. The motor 10 has a central axis 14. The rotor 12 rotates about the central axis 14. The stationary part 11 has an upper connecting portion 111 and a lower connecting portion 112. The rotor 12 is connected to the rotating parts 13. The rotor 12 drives the rotating parts 13 to rotate. The rotating parts 13 are spaced apart from the upper connecting portion 111 and the lower connecting portion 112 of the stationary part 11. The rotating parts 13 are defined as an upper rotating part 131 and a lower rotating part 132, respectively. The upper rotating part 131 and the lower rotating part 132 are disposed on the upper and lower sides of the motor 10, respectively. The rotating parts 13 rotates about the central axis 14. The rotating parts 13 each have a plurality of mounting portions 15 that are arranged around the central axis 14. The mounting portions 15 are located outside the stationary part 11. The mounting portions 15 are arranged at intervals. The upper connecting portion 111 and the lower connecting portion 112 are located on the upper and lower ends of the motor 10. The upper connecting portion 111 and the lower connecting portion 112 are close to the central axis 14. The rotating parts 13 are far away from the central axis 14.

The blades 20 each have a coupling portion 21. At least one of the blades 20 is fixed to each of the rotating parts 13. The coupling portion 21 of each blade 20 is secured to one of the mounting portions 15 of a corresponding one of the rotating parts 13 through a fixing unit 22. The number of the coupling portions 21 of the blades 20 secured to the upper rotating part 131 is less than the number of the mounting portions 15 of the upper rotating part 131. The number of the coupling portions 21 of the blades 20 secured to the lower rotating part 132 is less than the number of the mounting portions 15 of the lower rotating part 132. Each blade 20 is selectively secured to the mounting portion 15 of the corresponding rotating part 13. When in use, the positions of the blades 20 to be mounted are selective. The blades 20 mounted to the rotating parts 13 may be arranged in the same or different patterns. When the blades 20 are arranged in the same pattern, the double-layer blade ceiling fan 100 has the effect of enhancing the strength of air convection.

Figure 7:
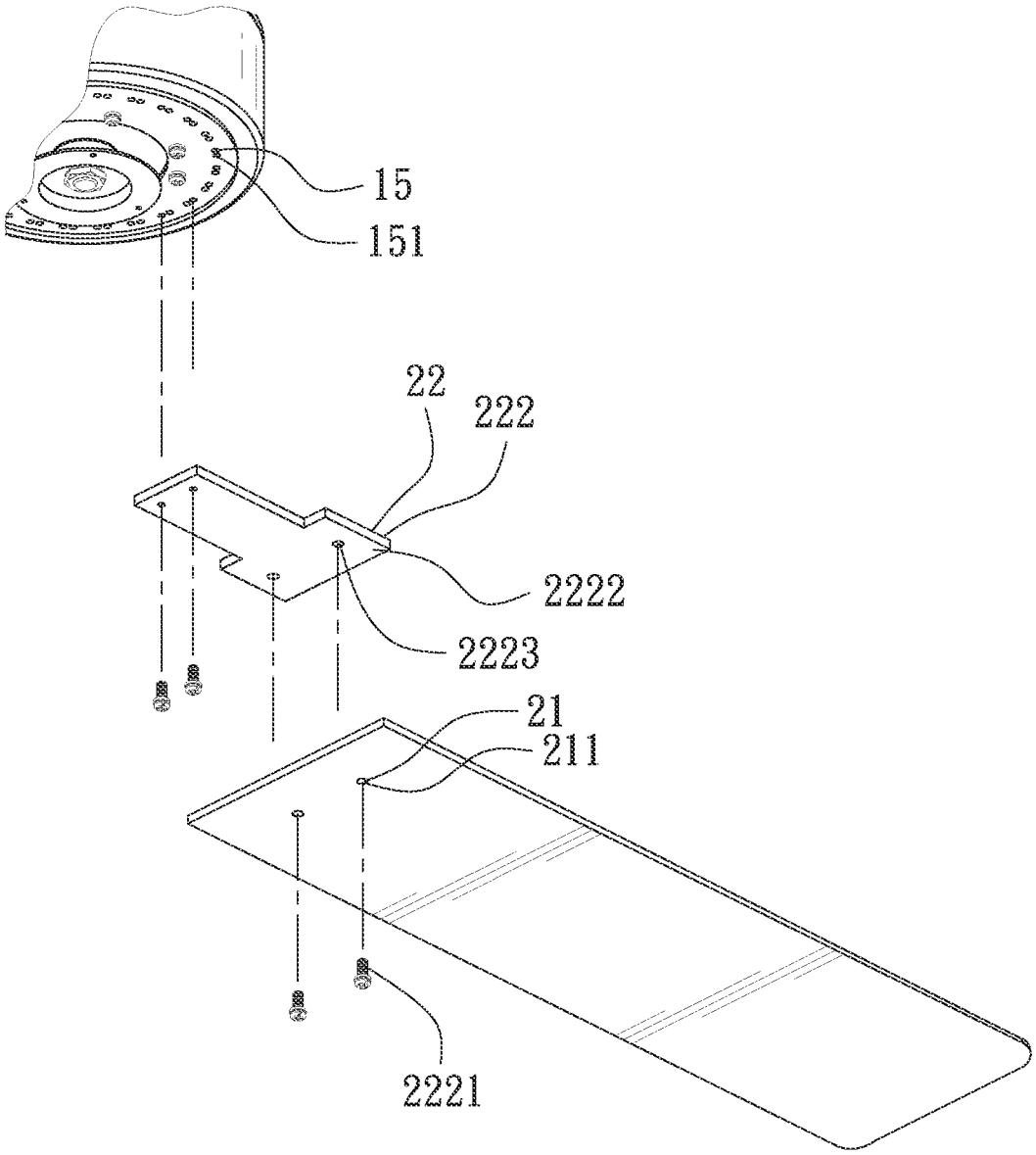
FIG. 7 is a schematic view of the second combination of the fixing unit of the present invention.

The mounting portions 15 each have a plurality of mounting holes 151. The coupling portion 21 has a plurality of coupling holes 211. The fixing unit 22 has one of a first combination 221 and a second combination 222. The first combination 221 is a plurality of locking parts 2211. The mounting holes 151 of the mounting portion 15 correspond to the coupling holes 211 of the coupling portion 21 and the locking parts 2211 of the fixing unit 22. Referring to FIG. 7, the second combination 222 is a plurality of fasteners 2221 and a bracket 2222. The bracket 2222 has a plurality of through holes 2223. The through holes 2223 of the bracket 2222 correspond to the mounting holes 151 of the mounting portion 15 and the coupling holes 211 of the coupling portion 21 and the fasteners 2221 of the fixing unit 22.

The mounting structure 30 is located above the motor 10. One end of the mounting structure 30 is fixedly connected to the upper connecting portion 111, and the other end of the mounting structure 30 is fixedly connected to a ceiling 101. The mounting structure 30 includes a down rod 31 and a mounting bracket 32. One end of the down rod 31 is fixedly connected to the upper connecting portion 111, and the other end of the down rod 31 is fixedly connected to the ceiling 101 through the mounting bracket 32.

The lamp 40 is located below the motor 10 and the blades 20. The lamp 40 is fixedly connected to the lower connecting portion 112.

Because the rotating parts 13 are spaced apart from each other and arranged around the stationary part 11, the upper connecting portion 111 and the lower connecting portion 112 are close to the central axis 14, and the rotating parts 13 are far away from the central axis 14, the upper connecting portion 111 and the lower connecting portion 112 each define a first distance a. The first distance a extends vertically from the central axis 14 to the upper connecting portion 111 and the lower connecting portion 112. The rotating parts 13 each define a second distance b. The second distance b extends vertically from the central axis 14 to the outer side walls of the rotating parts 13. The second distance b is greater than the first distance a. When the rotating parts 13 are rotated, the upper connecting portion 111 and the lower connecting portion 112 will not be affected.

The lamp 40 defines a third distance c. The third distance c extends vertically from the central axis 14 to the outer side wall of the lamp 40. The third distance c is not less than the second distance b, so that the lamp 40 can shelter the coupling portions 21 and the fixing units 22 of the blades 20 from being seen by an observer below.

The rotating parts 13 each may have at least four, at least ten or at least twenty-four mounting portions 15. In this embodiment, the rotating parts 13 each have twenty-four mounting portions 15. Two blades 20 are fixedly connected to each rotating part 13. The blades 20 fixed to the upper rotating part 131 are selectively fixed to two of the twenty-four mounting portions 15 of the upper rotating part 131. The blades 20 fixed to the upper rotating part 131 do not conflict with each other. The blades 20 fixed to the lower rotating part 132 are selectively fixed to two of the twenty-four mounting portions 15 of the lower rotating part 132. The blades 20 fixed to the lower rotating part 132 do not conflict with each other.

Figure 5:
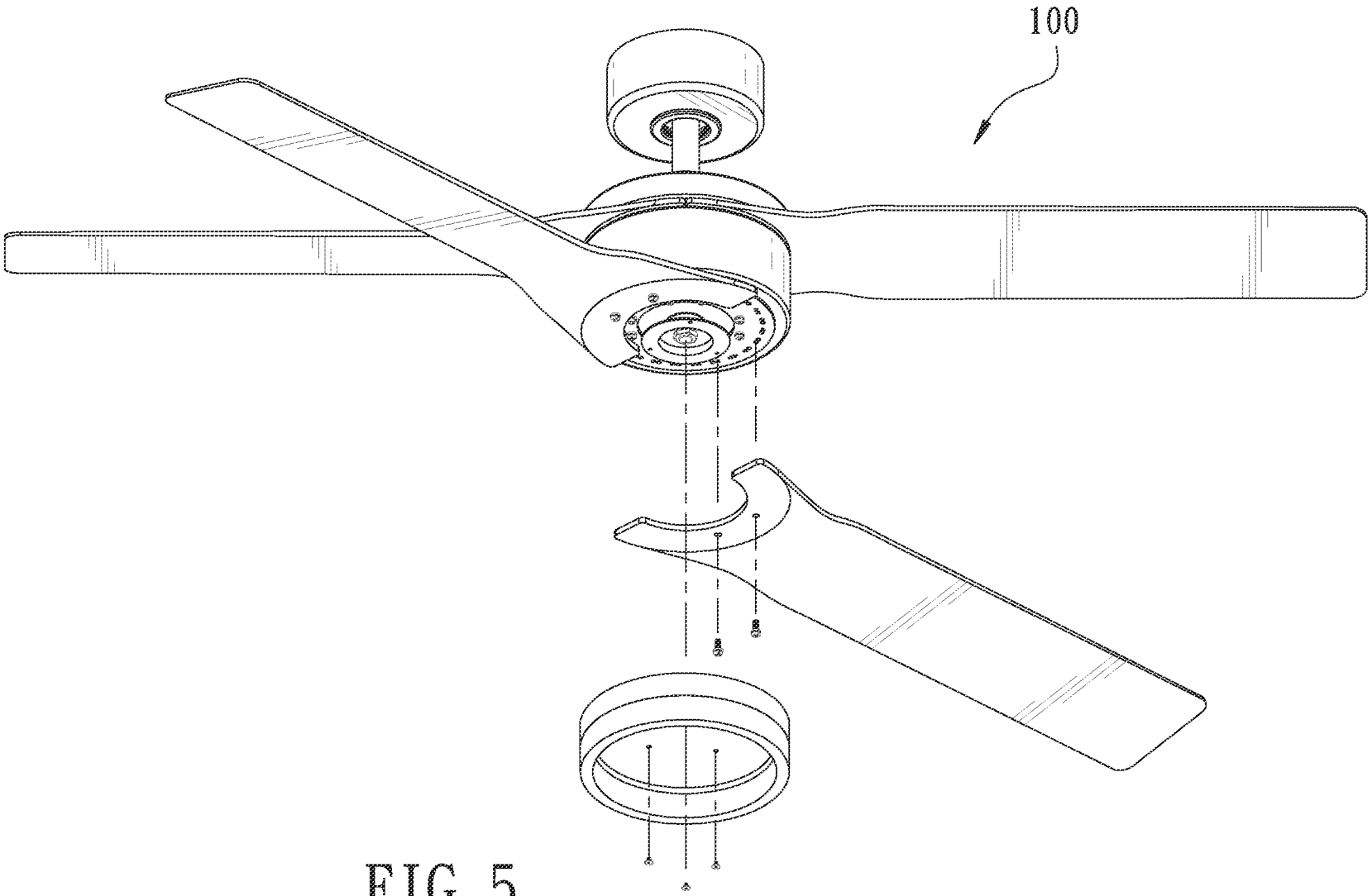
FIG. 5 is a partial exploded view of a second embodiment of the present invention, wherein the blades mounted to the rotating parts are arranged in different patterns.
Figure 6:
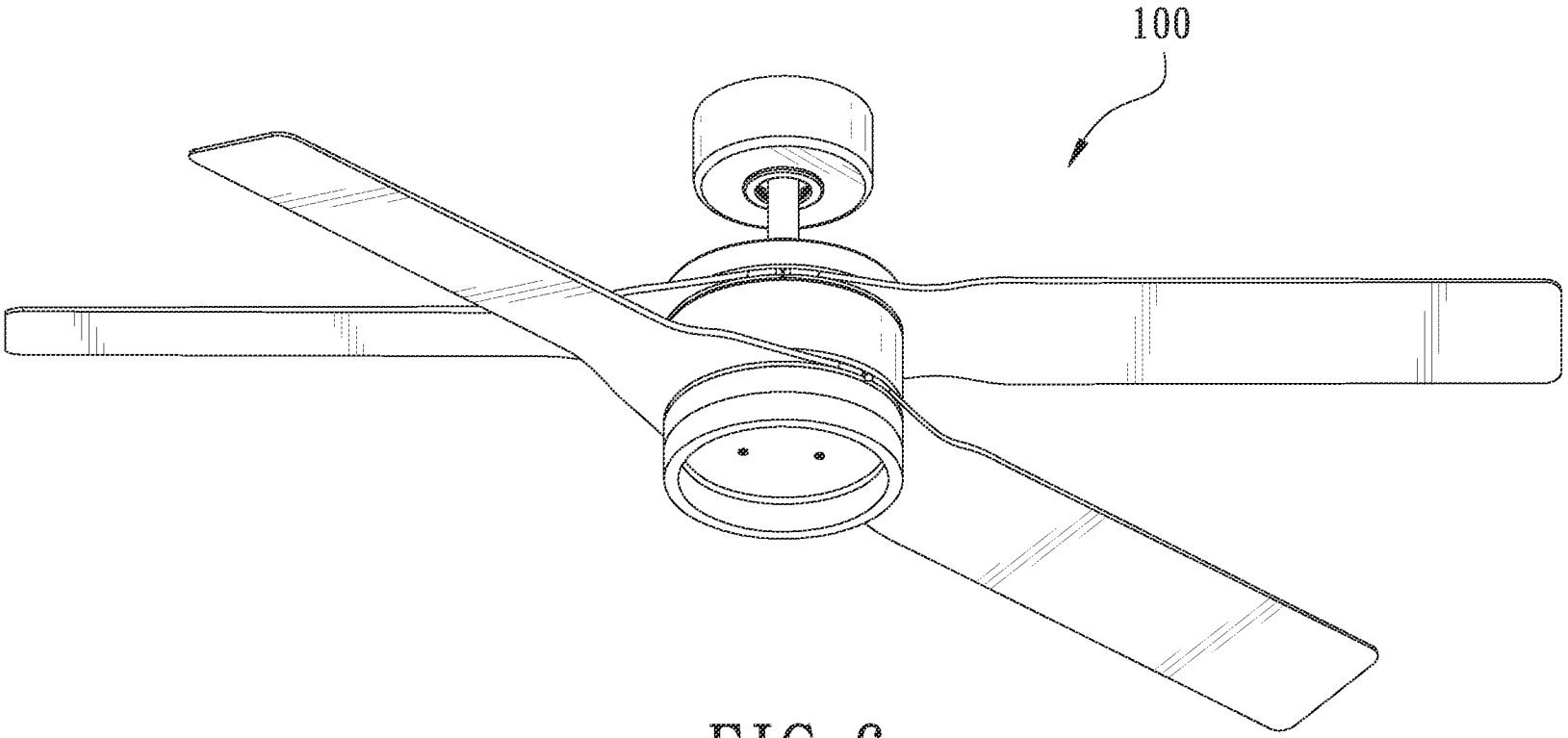
FIG. 6 is a schematic view of the second embodiment of the present invention when in use.

FIG. 5 and FIG. 6 illustrate a second embodiment of the present invention. The blades 20 mounted to the rotating parts 13 are arranged in different patterns, the double-layer blade ceiling fan 100 has the effect of regulating air flow and improving air convection.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A double-layer blade ceiling fan, comprising:

a motor, including a stationary part and two rotating parts, the motor having a central axis, the stationary part having an upper connecting portion and a lower connecting portion, the rotating parts being spaced apart from the upper connecting portion and the lower connecting portion of the stationary part, the rotating parts being defined as an upper rotating part and a lower rotating part respectively, the upper rotating part and the lower rotating part being disposed on upper and lower sides of the motor respectively, the rotating parts rotating about the central axis, the rotating parts each having a plurality of mounting portions that are arranged around the central axis, the upper connecting portion and the lower connecting portion upper being located on upper and lower ends of the motor, the upper connecting portion and the lower connecting portion being close to the central axis, the rotating parts being far away from the central axis;

at least two blades, the blades each having a coupling portion, at least one of the blades being fixed to each of the rotating parts, the coupling portion of each blade being secured to one of the mounting portions of a corresponding one of the rotating parts through a fixing unit, the number of the coupling portions of the blades secured to the upper rotating part being less than the number of the mounting portions of the upper rotating part, the number of the coupling portions of the blades secured to the lower rotating part being less than the number of the mounting portions of the lower rotating part, each blade being selectively secured to the mounting portion of the corresponding rotating part;

a mounting structure, located above the motor, one end of the mounting structure being fixedly connected to the upper connecting portion, another end of the mounting structure being fixedly connected to a ceiling;

wherein when in use, the positions of the blades to be mounted are selective, the blades mounted to the rotating parts are selectively arranged in a same or different pattern, when the blades and the rotating parts are rotated, the upper connecting portion and the lower connecting portion are not affected.

2. The double-layer blade ceiling fan as claimed in claim 1, further comprising a lamp, wherein the lamp is located below the motor and the blades, and the lamp is fixedly connected to the lower connecting portion.

3. The double-layer blade ceiling fan as claimed in claim 2, wherein the upper connecting portion and the lower connecting portion each define a first distance, the first distance extends vertically from the central axis to the upper connecting portion and the lower connecting portion, the rotating parts each define a second distance, the second distance extends vertically from the central axis to outer side walls of the rotating parts, and the second distance is greater than the first distance.

4. The double-layer blade ceiling fan as claimed in claim 3, wherein the lamp defines a third distance, the third distance extends vertically from the central axis to an outer side wall of the lamp, and the third distance is not less than the second distance.

5. The double-layer blade ceiling fan as claimed in claim 4, wherein the mounting portions each have a plurality of mounting holes, the coupling portion has a plurality of coupling holes, the fixing unit has one of a first combination and a second combination, the first combination is a plurality of locking parts, the mounting holes of the mounting portion correspond to the coupling holes of the coupling portion and the locking parts of the fixing unit, the second combination is a plurality of fasteners and a bracket, the bracket has a plurality of through holes, and the through holes of the bracket correspond to the mounting holes of the mounting portion and the coupling holes of the coupling portion and the fasteners of the fixing unit.

6. The double-layer blade ceiling fan as claimed in claim 4, wherein the mounting portions each have a plurality of mounting holes, the coupling portion has a plurality of coupling holes, the fixing unit has a plurality of locking parts, and the mounting holes of the mounting portion correspond to the coupling holes of the coupling portion and the locking parts of the fixing unit.

7. The double-layer blade ceiling fan as claimed in claim 4, wherein the mounting structure includes a down rod and a mounting bracket, one end of the down rod is fixedly connected to the upper connecting portion, and another end of the down rod is fixedly connected to the ceiling through the mounting bracket.

8. The double-layer blade ceiling fan as claimed in claim 4, wherein the motor further includes a rotor, the rotor rotates about the central axis, and the rotor drives the rotating parts to rotate.

9. The double-layer blade ceiling fan as claimed in claim 4, wherein the number of the mounting portions of each rotating part is four.

10. The double-layer blade ceiling fan as claimed in claim 4, wherein the number of the mounting portions of each rotating part is ten.

* * * * *